US009738441B2

(12) United States Patent
LeBlanc et al.

(10) Patent No.: US 9,738,441 B2
(45) Date of Patent: Aug. 22, 2017

(54) CONTAINMENT DEVICE FOR INTERMEDIATE BULK CONTAINERS, AND RELATED METHODS

(71) Applicant: Factory Mutual Insurance Company, Johnston, RI (US)

(72) Inventors: John A LeBlanc, Milford, MA (US); Christopher J. Wieczorek, Foxboro, MA (US)

(73) Assignee: Factory Mutual Insurance Company, Johnston, RI (US)

( * ) Notice: Subject to any disclaimer, the term of this patent is extended or adjusted under 35 U.S.C. 154(b) by 202 days.

(21) Appl. No.: 14/295,961

(22) Filed: Jun. 4, 2014

(65) Prior Publication Data

US 2015/0353277 A1 Dec. 10, 2015

(51) Int. Cl.
*B65D 21/02* (2006.01)
*B65D 61/00* (2006.01)
(Continued)

(52) U.S. Cl.
CPC ..... *B65D 90/24* (2013.01); *B65D 1/12* (2013.01); *B65D 90/12* (2013.01); *Y10T 29/49828* (2015.01)

(58) Field of Classification Search
CPC ..... B65D 81/262; B65D 90/24; B65D 2519/00024; B65D 2519/00164;
(Continued)

(56) References Cited

U.S. PATENT DOCUMENTS 3,692,205 A 9/1972 Cowles et al.
4,884,711 A 12/1989 Bomhard et al.
(Continued)

FOREIGN PATENT DOCUMENTS

CH 543 430 A 10/1973
DE 88 01 024.4 U1 3/1988
(Continued)

OTHER PUBLICATIONS

International Search Report issued Jun. 5, 2015 in International Patent Application No. PCT/US2015/023004.
(Continued)

*Primary Examiner* — Andrew T Kirsch
(74) *Attorney, Agent, or Firm* — Venable LLP; Steven J. Schwarz

(57) ABSTRACT

Described is a containment device for holding a container that defines a container interior volume. The containment device can include a base portion enclosing a base portion interior volume, the base portion including: a plurality of base walls, a trough extending from at least one of the base walls, and a substantially horizontal support surface adapted to support the container above the base portion interior volume. The base portion interior volume can be equal to or greater than the container interior volume. An enclosure can extend above the base portion, the enclosure including a plurality of enclosure walls adapted to surround the container. The enclosure walls can define an opening above the trough, the opening adapted for insertion of the container into the enclosure.

20 Claims, 4 Drawing Sheets

(51) Int. Cl.

| | |
|---|---|
| ***B65D 81/26*** | (2006.01) |
| ***B65D 90/24*** | (2006.01) |
| ***B67D 1/16*** | (2006.01) |
| ***B67D 3/00*** | (2006.01) |
| ***E04C 2/42*** | (2006.01) |
| ***E04B 1/08*** | (2006.01) |
| ***B65D 90/12*** | (2006.01) |
| ***B65D 1/12*** | (2006.01) |

(58) Field of Classification Search

CPC .... B65D 2519/00393; B65D 2519/008; B65D 61/00; B65D 90/12; B67D 1/16; B67D 3/0083; E04B 1/08; E04C 2/42

USPC ..... 220/23.91

See application file for complete search history.

(56) References Cited

U.S. PATENT DOCUMENTS

| | | | | |
|---|---|---|---|---|
| 5,052,582 | A | 10/1991 | Hall | |
| 5,092,251 | A | 3/1992 | Hamaker et al. | |
| 5,118,004 | A * | 6/1992 | Carilli | B65D 90/24 108/24 |
| 5,254,798 | A | 10/1993 | Zoback | |
| 5,307,931 | A | 5/1994 | Gillispie et al. | |
| 5,480,191 | A * | 1/1996 | Litin | B62B 1/264 141/88 |
| 5,547,096 | A | 8/1996 | Kleyn | |
| 5,642,834 | A | 7/1997 | Shaw et al. | |
| 5,704,476 | A | 1/1998 | Abbott | |
| 5,813,739 | A | 9/1998 | White | |
| 6,045,000 | A * | 4/2000 | Rauworth | B65D 1/12 220/203.01 |
| 6,149,026 | A | 11/2000 | Manson | |
| 6,189,720 | B1 * | 2/2001 | Gillispie | B65D 90/24 141/311 A |
| 6,244,459 | B1 | 6/2001 | Bouc et al. | |
| 6,276,404 | B1 | 8/2001 | Birtcher et al. | |
| 6,299,008 | B1 | 10/2001 | Payne | |
| 6,305,131 | B1 | 10/2001 | Romig | |
| 6,382,108 | B1 | 5/2002 | Stanek et al. | |
| 6,745,704 | B2 | 6/2004 | Carter et al. | |
| 7,234,608 | B2 | 6/2007 | Reed et al. | |
| 7,967,164 | B1 | 6/2011 | Mountain | |
| 2001/0038009 | A1 | 11/2001 | Payne | |
| 2008/0078768 | A1 | 4/2008 | Apostoluk | |
| 2009/0242571 | A1 | 10/2009 | Claborn | |
| 2011/0210027 | A1 | 9/2011 | Decroix | |
| 2013/0131420 | A1 | 5/2013 | Culp | |

FOREIGN PATENT DOCUMENTS

| | | | |
|---|---|---|---|
| DE | 89 13 716.7 | U1 | 2/1990 |
| DE | 93 10 406 | U1 | 9/1993 |
| DE | 20 2009 010 748 | U1 | 12/2009 |
| DE | 20 2013 009020 | U1 | 1/2014 |
| EP | 2 537 768 | A2 | 12/2012 |
| GB | 2 206 147 | A | 12/1988 |
| GB | 2 398 059 | A | 8/2004 |
| WO | WO-01/25101 | A1 | 4/2001 |
| WO | WO-2012/028237 | A1 | 3/2012 |

OTHER PUBLICATIONS

Written Opinion issued Jun. 5, 2015 in International Patent Application No. PCT/US2015/023004.

Die Minimax Brandschutzwanne, http://www.minimax-mobile.com/Brandschutzwanne.166.0.html, retrieved from internet on Jun. 10, 2015.

Denios IBC Tote Sump Enclosed, https://www.denios-us.com/ibc-tote-sump-enclosed-w-access-galvanized.html, retrieved from internet on Jun. 10, 2015.

* cited by examiner

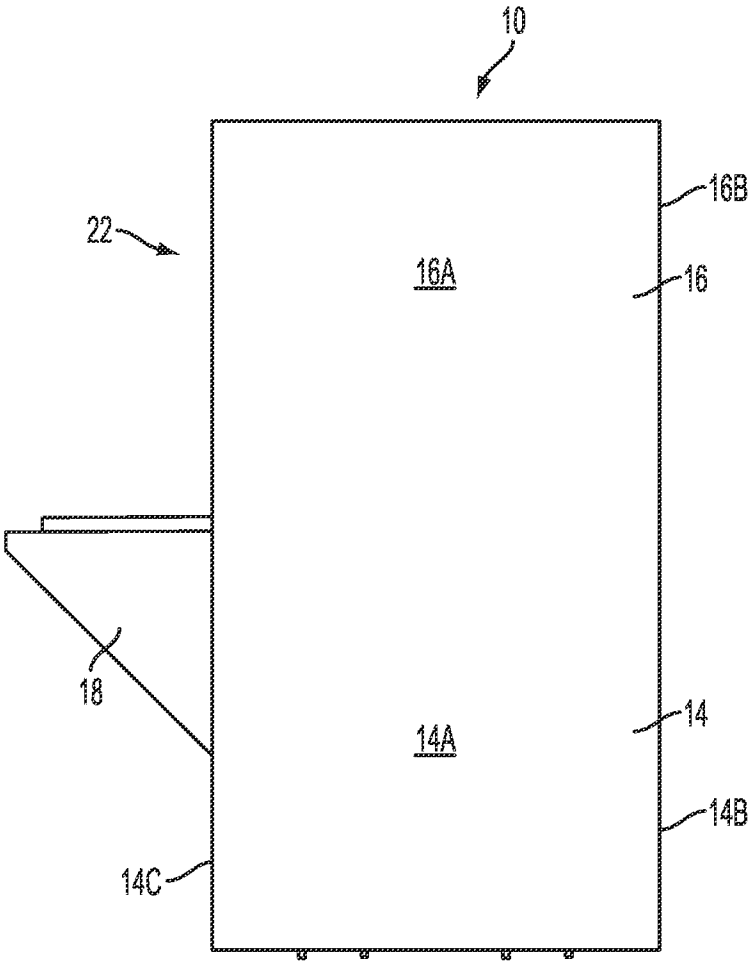
FIG. 1
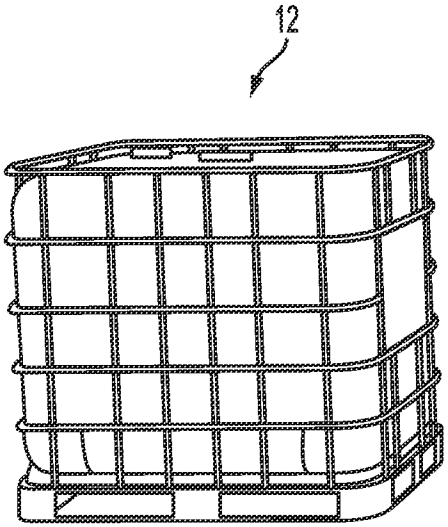

CONTAINMENT DEVICE FOR INTERMEDIATE BULK CONTAINERS, AND RELATED METHODS

TECHNICAL FIELD

This patent application relates generally to containers, for example, for storing chemicals or other liquids or granulates. More specifically, this patent application related to a containment device for holding and protecting intermediate bulk containers, and related methods.

BACKGROUND

The term Intermediate Bulk Container (IBC) typically refers to an industrial container designed for the transport and storage of bulk liquid and granulate substances (e.g., chemicals, food ingredients, solvents, pharmaceuticals, etc.). IBCs are typically stackable containers mounted on a pallet, which are designed to be moved using a forklift or a pallet jack. IBCs typically have a volume of between about 500 liters and about 3000 liters, with the most common sizes being 1040 liters and 1250 liters.

One type of IBC is the composite IBC, which is a blow molded plastic (e.g., polyethylene) container housed within a tubular reinforced stainless steel cage. The container is attached to a pallet, or the bottom of the cage can be formed into a pallet. As an alternative to plastic, IBCs can also be manufactured out of fiberboard, wood, heavy gauge plastic, aluminum, carbon steel, and stainless steel.

If unprotected, IBCs can rupture when exposed to high heat, such as flames. This can lead to spillage of the IBC's contents. Additionally, IBC can be accidentally pierced, for example, by a fork lift. This can also lead to spillage of the contents of the IBC.

In the case of IBCs containing flammable or combustible liquids, piercing or otherwise rupturing the IBC can quickly result in a large pool of flammable or combustible liquid, which if subject to flames, can create a large floor fire.

SUMMARY

According to an embodiment, described is a containment device for holding a container that defines a container interior volume. The containment device can include a base portion enclosing a base portion interior volume, the base portion including: a plurality of base walls, a trough extending from at least one of the base walls, and a substantially horizontal support surface adapted to support the container above the base portion interior volume. The base portion interior volume can be equal to or greater than the container interior volume. An enclosure can extend above the base portion, the enclosure including a plurality of enclosure walls adapted to surround the container, wherein the enclosure walls define an opening above the trough, the opening adapted for insertion of the container into the enclosure.

According to another embodiment, described is a method of protecting a container defining a container interior volume. The method can include providing a containment device having a base portion and an enclosure extending upward above the base portion, the enclosure defining at least one open side; and inserting the container into the enclosure through the at least one open side, whereby the container is positioned above the base portion. The base portion can enclose a base portion interior volume that is equal to, or greater than, the container interior volume.

BRIEF DESCRIPTION OF THE DRAWINGS

The features and advantages of the invention will be apparent from the following description, as illustrated in the accompanying drawings wherein like reference numbers generally indicate identical, functionally similar, and/or structurally similar elements.

FIG. 1 is a side perspective view of an embodiment of an IBC and a containment device for use with the IBC.

DETAILED DESCRIPTION

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention.

Referring to FIG. 1, an embodiment of a containment device 10 is shown. FIG. 1 also shows an example of a container 12 located outside the containment device 10. The container 12 can be used to hold liquids, granulates, and other substances, including flammable substances.

The containment device 10 can be used to protect the container 12 from events that would lead to spillage of its contents. For example, the containment device 10 can shield the sides of the container 12 from puncture, for example, by a fork lift or other object. The containment device 10 can also protect the container 12 from failure due to exposure to heat, flames, chemicals, etc.

The container 12 is shown in FIG. 1 as an intermediate bulk container (IBC) including a plastic volume surrounded by a metal cage. Other types of IBCs are possible, including metal and composite IBCs. According to embodiments, the container 12 may define an interior volume (referred to for convenience as a "container interior volume") of between about 500 liters and about 3,000 liters. Alternatively, the container 12 may be a drum, such as a plastic or metal drum defining a container interior volume of between about 200 liters and about 500 liters. One of ordinary skill in the art will appreciate, however, that the containment device 10 is not limited to use with any specific type, material, or size container 12.

Figure 2:
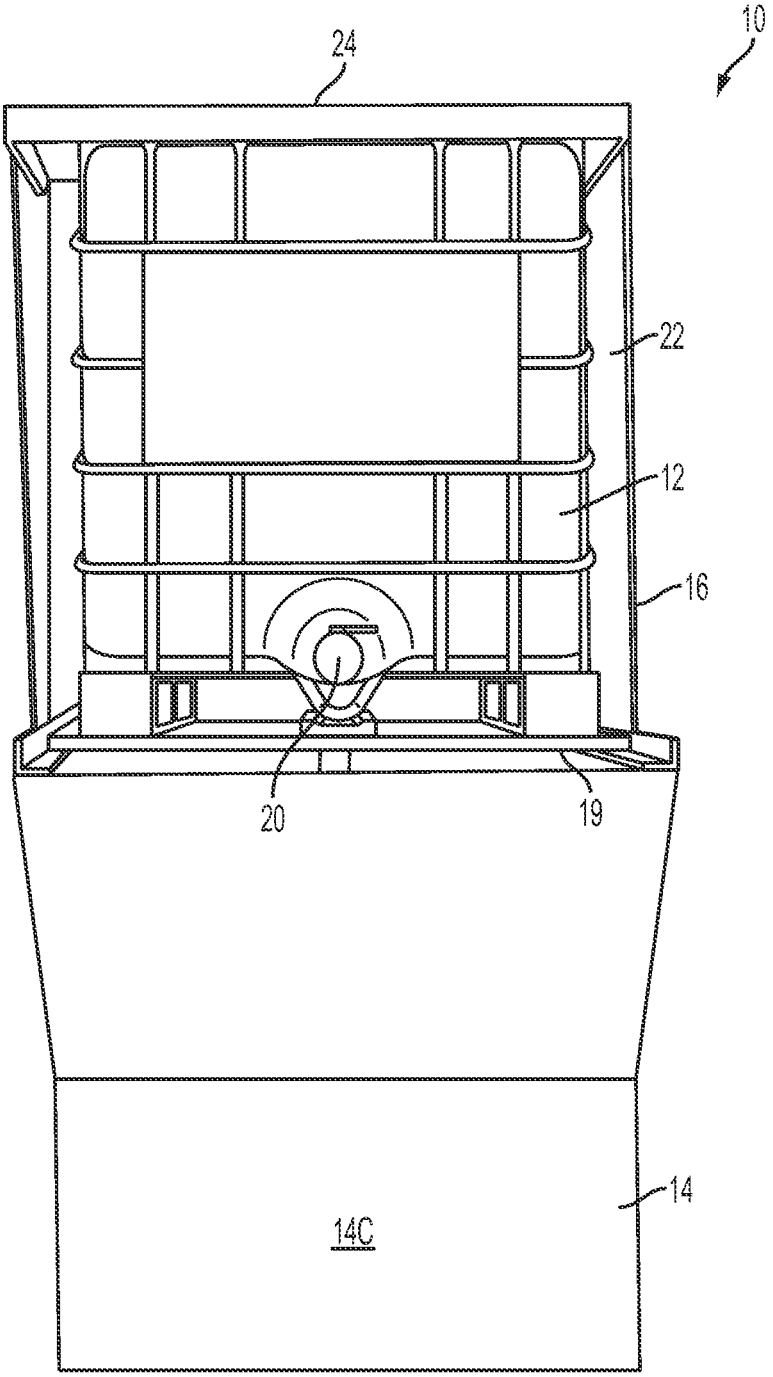
FIG. 2 is a front view of the containment device of FIG. 1, shown housing the IBC.

Still referring to FIG. 1, the containment device 10 can include a lower section that defines a base portion 14, and an upper portion that defines an enclosure 16. The enclosure 16 can have one or more walls 16A, 16B, etc. that surround all or some of the container 12, and can protect the container 12 from rupture caused by external sources, e.g., piercing or high heat. With reference to FIG. 2, the enclosure 16 can also include a roof 24 located atop the walls 16A, 16B, etc.

The base portion 14 can support the container 12, and can serve as a catch basin for liquids, granulates, or other substances that may leak from the container 12, for example, in the event of a rupture. Although described using different names, according to embodiments, the base portion 14 and enclosure 16 can be integral with one another, or alternatively, they can comprise separate units. According to embodiments where the base portion 14 and enclosure 16 are separate units, they can be connected together, for example, using fasteners, couplers, or other structural materials known in the art.

Figure 3:
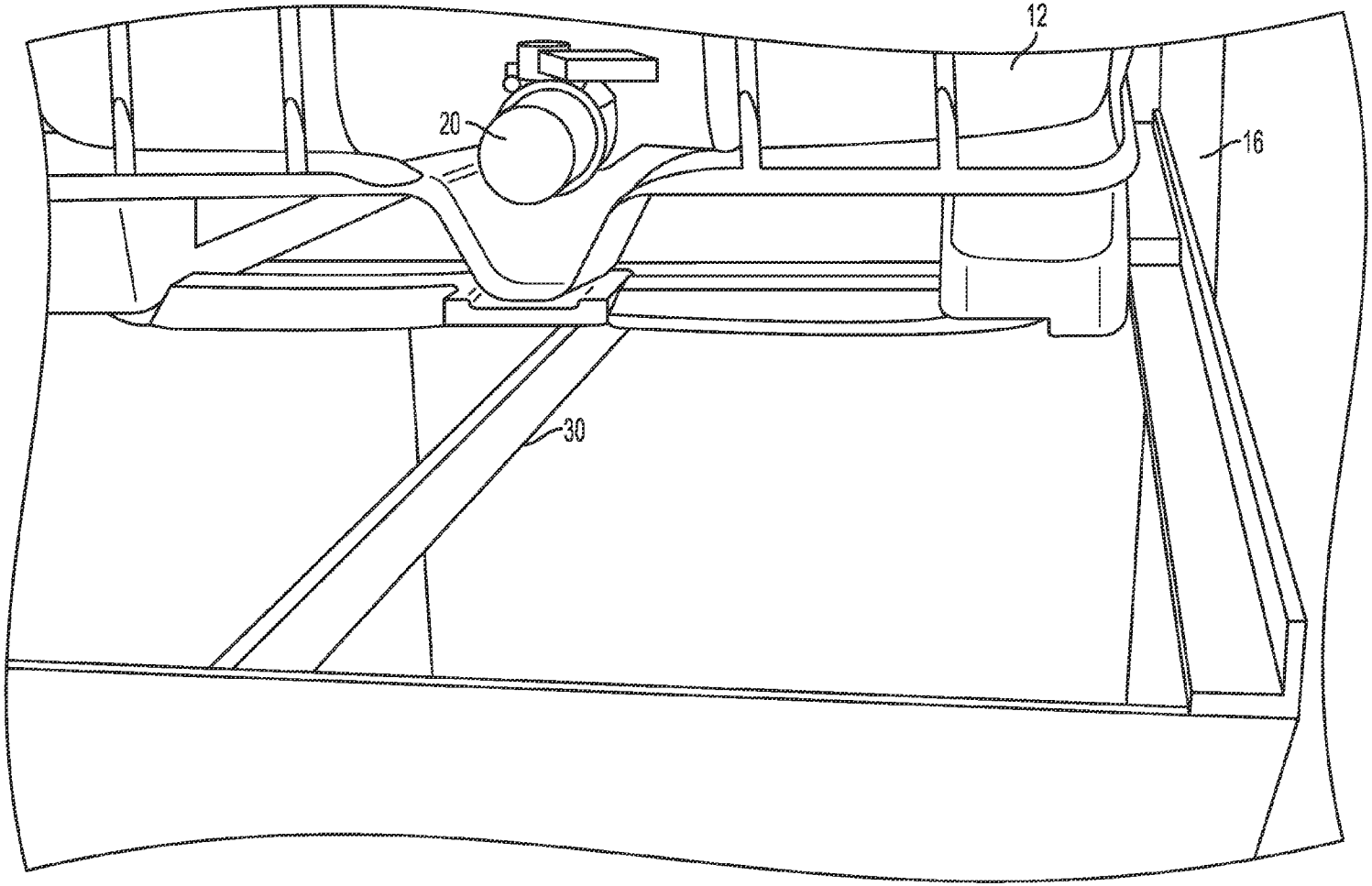
FIG. 3 is an enlarged view of a portion of the containment device and IBC of FIG. 2.
Figure 4:
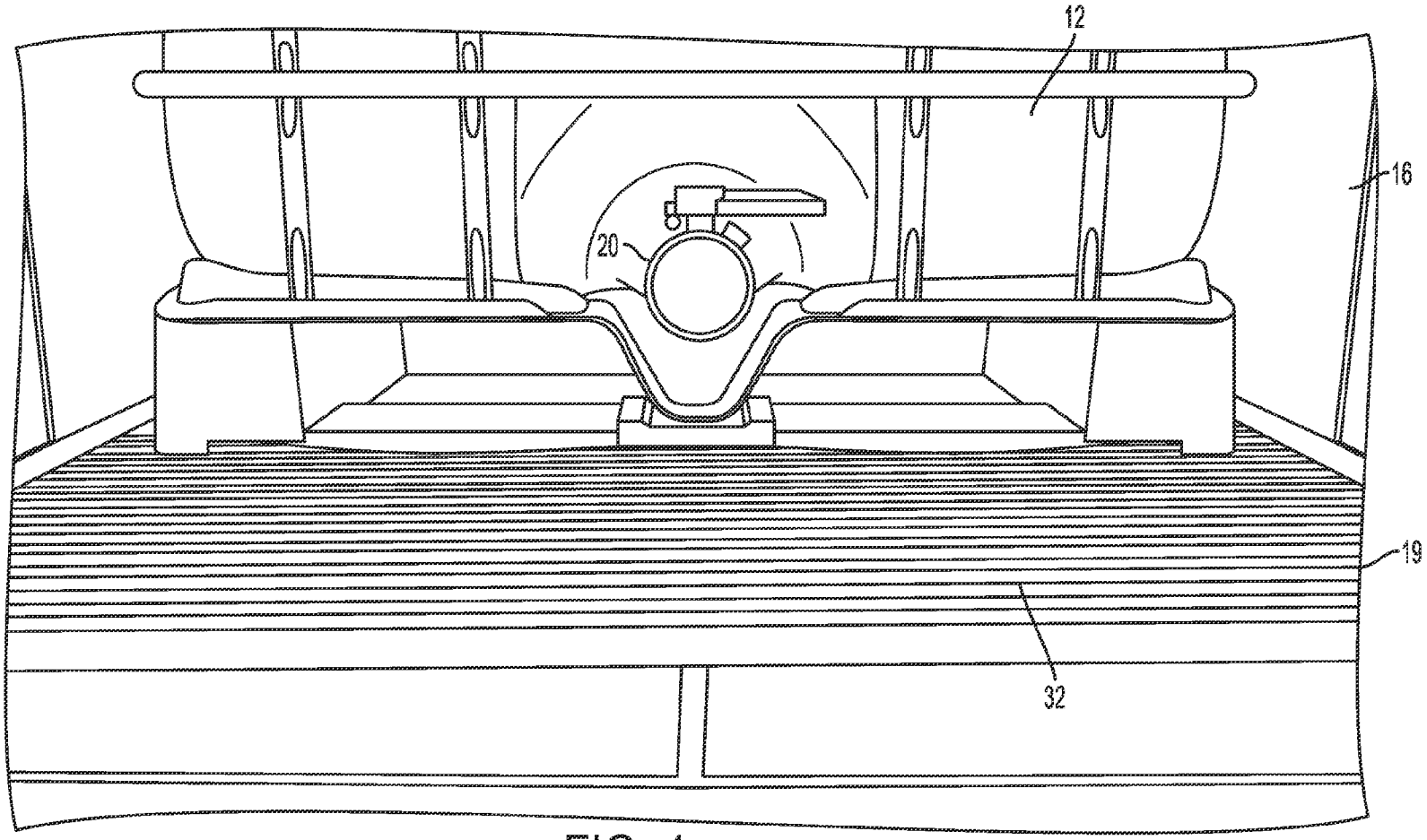
FIG. 4 is another enlarged view of a portion of the containment device and IBC of FIG. 2.

Still referring to FIG. 1, the containment device 10 can also include a trough 18 extending from a portion of the base portion 14. As shown in FIGS. 2-4, the container 12 can be located in the enclosure 16 with its dispensing valve 20 located above the trough 18. As a result, the trough 18 can catch any substances leaking from the container 12, for example, due to a leaky valve, or accidental opening of the valve. Referring to FIGS. 1 and 2, the enclosure 16 can have an opening 22 that permits insertion and removal of the container 12 from the enclosure 16. According to embodiments, the trough 18 can be aligned with the opening 22, such that any spray from the container 12, for example, due to a rupture near the opening 22, will be caught by the trough 18.

Referring to FIG. 2, the base portion 14 and the enclosure 16 can be separated by a substantially horizontal support surface 19, which supports the container 12 above the base portion 14. The support surface 19 can be configured to support the container 12 above the base portion 14, while at the same time, permitting liquids, granulates, and other objects to pass through the support surface into the base portion 14. For example, the support surface 19 can comprise a grated surface, a plurality of spaced apart rails, or other configurations that permit the passage of liquids, granulates, etc.

The base portion 14, including the trough 18, can enclose a base portion interior volume that is equal to or greater than the container interior volume of a container 12 that fits within the enclosure 16. As a result, in the event the container 12 were to leak—e.g. due to rupture—the base portion 14 can collect substantially all of the contents of the container 12, thereby reducing spillage of the contents of container 12 onto the floor surrounding the containment device 10. In the case of flammable substances, this can reduce the footprint of flammable substances on the floor, and reduce the size, heat release rate and temperature of any fire surrounding the container. This can, in turn, reduce the spread of fire to adjacent containers, the reduced heat release rate will limit the number of sprinklers that would operate at the ceiling. According to embodiments, the base portion interior volume can be about 1.1 to about 1.5 times the container interior volume of a container 12 that fits within enclosure 16.

Referring to FIGS. 1 and 2 together, the base portion 14 can include one or more base walls 14A, 14B, 14C that together define and enclose the base portion interior volume. The trough 18 can extend from one of the base walls. For example, one of the base walls (14C in FIGS. 2 and 3) can be truncated, e.g., shorter than the other walls, and the trough can extend at an angle upwards and outwards from an upper end of the truncated wall. Accordingly, the trough 18 can define an open upper portion. One of ordinary skill in the art will understand from this disclosure that the trough 18 is not limited to the configuration shown and described, and that other shapes and/or configurations can be used to form the trough.

Referring to FIGS. 3 and 4, a second substantially horizontal surface can cover the open upper portion of the trough 18. For example, as shown in FIG. 3, the second surface can comprise one or more spaced apart rails 30 that extends across the open upper portion, or as shown in FIG. 4, the second surface can comprise a grated surface 32 covering the open upper portion. According to embodiments, the rails 30 or grated surface 32 can be co-planar (or co-extensive) with the substantially horizontal surface 19, however, other configurations are possible. According to embodiments, the open upper portion of the trough 18 can define an area that is between about 10% and about 50% of the area of the substantially horizontal surface 19. However, one of ordinary skill in the art will understand based on this disclosure that other ratios may be used, provided the open upper portion of the trough extends far enough away from the container 12 within the enclosure 16 to collect spray emanating from a rupture in a sidewall of the container 12.

FIGS. 1-4 depict the containment device 10 as a having a predominantly rectangular or square horizontal cross-section. According to such embodiments, the enclosure portion 16 may define interior lengths, widths, and heights of between about 1 meter and about 2 meters each, however, other dimensions are possible. In addition, other shapes are possible. For example, for containment devices 10 intended for use with cylindrical barrels, the containment device may have a substantially round cross-section. One of ordinary skill in the art will understand from this disclosure that a variety of horizontal cross-sections, and combinations of cross-sections, can be used for the containment device 10 depending on the shape and size of containers 12 intended for use with the containment device 10.

As mentioned previously, the containment device 10 can be used to protect the container 12, and to collect any substances that may be spilled from the container 12. Referring to FIGS. 1 and 2, the container 12 may be inserted into the enclosure 16 through the opening 22, such that the container 12 is supported on the substantially horizontal surface 19 above the base portion 14 and surrounded by the enclosure 16 on three of its four sides. For containers 12 including a valve 20 (e.g., for dispensing materials from the container 12, or for connecting to conduits, etc.) the side of the container 12 with the valve 20 can be positioned through the opening 22 and above the trough 18. The container 12 can be subsequently removed from the enclosure 16, and replaced with a different container 12, as needed.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A containment device for holding an intermediate bulk container that defines a container interior volume of between about 500 liters and about 3,000 liters, the containment device comprising:

a base portion enclosing a base portion interior volume, the base portion including:

a plurality of base walls, a trough extending from at least one of the base walls, a first substantially horizontal support surface adapted to support the container, wherein the base portion interior volume is underneath the first substantially horizontal support surface, wherein the base portion interior volume is between about 1.1 and about 1.5 times the container interior volume, and a second substantially horizontal surface substantially coplanar with the first substantially horizontal support surface and positioned above the trough; and an enclosure extending above the base portion, the enclosure including a plurality of enclosure walls, each enclosure wall defining an interior height of between about 1 meter and about 2 meters that extends above the first substantially horizontal support surface;

wherein the enclosure defines an opening above the trough, the opening being perpendicular to the first substantially horizontal support surface.

2. The containment device of claim 1, wherein the first substantially horizontal support surface is adapted for passage of liquid through the first substantially horizontal support surface.

3. The containment device of claim 1, wherein the first substantially horizontal support surface comprises a grated surface.

4. The containment device of claim 1, wherein the first substantially horizontal support surface comprises a plurality of spaced rails.

5. The containment device of claim 1, wherein one of the base walls comprises a truncated wall, and the trough comprises an inclined wall extending upwardly away from an upper region of the truncated wall to define an open upper portion of the trough.

6. The containment device of claim 1, wherein the second substantially horizontal surface covers the open upper portion of the trough.

7. The containment device of claim 1, wherein the second substantially horizontal surface defines an area between about 10% and about 50% of the area of the first substantially horizontal support surface.

8. The containment device of claim 1, wherein the second substantially horizontal surface comprises a grated surface.

9. The containment device of claim 1, wherein the second substantially horizontal surface comprises a plurality of spaced rails.

10. The containment device of claim 1, wherein at least a portion of the enclosure is integral with the base portion.

11. The containment device of claim 1, wherein at least some of the base walls and at least some of the enclosure walls are metal.

12. The containment device of claim 1, wherein the base portion defines a horizontal cross-section that is substantially rectangular or square.

13. The containment device of claim 1, wherein the enclosure defines a horizontal cross-section that is substantially rectangular or square.

14. The containment device of claim 1, wherein the enclosure defines an interior width between about 1 meter and about 2 meters, and an interior length between about 1 meter and about 2 meters.

15. A method of protecting an intermediate bulk container defining a container interior volume, the method comprising:

providing a containment device having a base portion enclosing a base portion interior volume, an enclosure extending upward above the base portion, the enclosure including a plurality of sidewalls defining an open side, and a trough located underneath the open side, the trough extending from the base portion; and inserting an intermediate bulk container into the enclosure through the open side, the container having a dispensing valve positioned on a side of the container, whereby the container is positioned on a first substantially horizontal support surface above the base portion interior volume with the dispensing valve located above the trough;

providing a second substantially horizontal surface substantially coplanar with the first substantially horizontal support surface and positioned above the trough;

wherein the base portion interior volume is equal to, or greater than, the container interior volume; and wherein the base portion volume is underneath the first substantially horizontal support surface, and the open side of the enclosure is perpendicular to the first substantially horizontal support surface.

16. The method of claim 15, wherein inserting the container into the enclosure comprises placing the container on the first substantially horizontal support surface.

17. The method of claim 15, wherein the first substantially horizontal support surface comprises a grated surface and/or a plurality of spaced apart rails.

18. The method of claim 15, wherein the container interior volume is between about 500 liters and about 3,000 liters.

19. The method of claim 15, wherein the base portion interior volume is between about 1.1 and about 1.5 times the container interior volume.

20. A containment device for holding an intermediate bulk container that defines a container interior volume, the containment device comprising:

a base portion enclosing a base portion interior volume, the base portion including:

a plurality of base walls, a trough extending from at least one of the base walls, a first substantially horizontal support surface, wherein the base portion interior volume is underneath the first substantially horizontal support surface, wherein the base portion interior volume is equal to or greater than the container interior volume, and a second substantially horizontal surface substantially coplanar with the first substantially horizontal support surface and positioned above the trough; and an enclosure extending above the base portion, the enclosure including a plurality of vertical enclosure walls adapted to surround the container, and a roof connected to the plurality of vertical enclosure walls, wherein the enclosure defines an opening above the trough, the opening extending perpendicular to the first substantially horizontal support surface.

* * * * *